United States Patent [101]

Whiteman, Sr., deceased et al.

[11] 4,052,756

[45] Oct. 11, 1977

[54] WET TYPE MARINE JET TOILET

[76] Inventors: Marvin E. Whiteman Sr., deceased, late of Coronado Cays, Calif.; Willene Whiteman, co-executor, No. 5 The Point, Coronado Cays, Calif. 92118; Marvin E. Whiteman, Jr., co-executor, 1010 Antelope Mountain Road, Big Bear City, Calif. 92314; Gary DeLong Whiteman, co-executor, 18643 Vintage St., Northridge, Calif. 91324

[21] Appl. No.: 684,922

[22] Filed: May 10, 1976

[51] Int. Cl.[2] ..... E03D 11/02; E03D 11/18

[52] U.S. Cl. ..... 4/73; 4/69 A; 4/69 R; 4/95

[58] Field of Search ..... 4/77, 73, 76, 75, 89, 4/90, 95, 69 R, 69 A

[56] References Cited

U.S. PATENT DOCUMENTS

| | | | |
|---|---|---|---|
| 1,205,078 | 11/1916 | Barron | 4/73 |
| 1,211,137 | 1/1917 | Grant | 4/73 |
| 1,838,198 | 12/1931 | Sloan | 4/73 |
| 1,973,349 | 9/1934 | Kruse | 4/73 |
| 2,129,398 | 9/1938 | Beam | 4/73 |
| 3,010,115 | 11/1961 | Wiggs | 4/69 |
| 3,648,297 | 3/1972 | MacMillan | 4/73 |
| 3,843,978 | 10/1974 | Ragot | 4/73 |

*Primary Examiner*—Henry K. Artis

*Attorney, Agent, or Firm*—Whann & McManigal

[57] ABSTRACT

A wet type marine toilet of the jet flushing type, wherein a reservoir tank is provided in a branch line connection to a top flushing rim of the bowl to delay the flushing action, and to impound fluid during the flushing operation, and upon termination of the flushing operation to discharge impounded fluid through the bowl bottom discharge outlet so as to form a normal fluid level in the bowl.

10 Claims, 2 Drawing Figures

WET TYPE MARINE JET TOILET

PRIOR ART

In the prior art there are numerous marine toilet structures and flushing systems therefor, and which encompass both "dry" and "wet" types. The closest art known to applicant is the following patents:

U.S. Pat. No. 2,886,826 — May 19, 1959
U.S. Pat. No. 3,010,115 — Nov. 28, 1961
U.S. Pat. No. 3,035,274 — May 22, 1962
U.S. Pat. No. 3,510,885 — May 12, 1970
U.S. Pat. No. 3,648,297 — Mar. 24, 1972

BACKGROUND OF THE INVENTION

The present invention relates generally to the field of toilets.

It has been known heretofore in the prior art to provide a marine type toilet of the so-called dry type in which the bowl is connected with a controlled fluid pressure source which provides fluid for a flushing rim arrangement and also fluid for a high pressure jet nozzle arranged to discharge across a depending bowl outlet sump at the bottom of the bowl, the discharge nozzle serving to produce a Venturi action which induces the discharge from the toilet bowl to flow into a suitable outlet connection. In this known arrangement, a branch connection connects the flushing rim with the controlled fluid pressure source at a point upstream of the jet nozzle.

The Wiggs U.S. Pat. No. 3,010,115, as indicated above in connection with the known prior art, discloses a flushing system for a commode in which a branch water supply from the main water supply is utilized for impounding of water in a tank from which it is carried and distributed to the top of the bowl for washing the bowl during flushing, and at the conclusion of the flushing operation operates to feed water by gravity through the flushing rim to reestablish a water level in the bottom of the bowl. This is a different concept than that of the present invention, wherein the water from a reservoir tank is utilized to provide a delay in the rim flushing operation, and at the conclusion of the flushing operation functions to return fluid from the tank to the main flushing flow channel at the bottom of the toilet so as to reestablish fluid level in the toilet bowl.

In the present invention, pressurized flushing fluid is connected from a fluid source under the control of a valve such as an electrically operated valve, to a jet nozzle arranged to eject a discharge jet across a bottom sump of the toilet bowl, and into an aligned outlet connection leading to a suitable discharge conduit and trap of conventional arrangement. Upstream of the jet nozzle, a branch conduit leads into the bottom of a reservoir tank which is supported at the back of the toilet bowl. This tank is of about one-quart capacity, and at its uppermost end sealingly supports a tubular member which has one end projecting from a side wall to the exterior of the tank, this end being arranged for sealed connection with a wall opening having communication with the rim flushing structure of the bowl. The other end of the tubular member projects outwardly of an opposite wall and is provided with a threaded end containing a flanged nut which is operable to compress appropriate sealing members for the tubular member at the tank walls and its connection with the wall opening of the bowl. The outermost end of the tubular member is closed by a screw cap. Within the tank, a small opening in the top portion of the tubular member provides flow communication between the interior of the tank and the rim flushing arrangement. This simple arrangement will convert an otherwise dry type marine toilet into a wet type. As thus arranged, when the electric control valve is opened to begin a flushing operation, there will simultaneously be produced a jet action from the jet nozzle, and a flow of flushing fluid upwardly into the reservoir tank, and thence into the rim flushing channel. This latter action takes place with a slight delay. Upon termination of the flushing, by closure of the electric valve, the jet action ceases and the water which has been impounded in the reservoir tank will now flow downwardly and be discharged through the jet into the sump and upwardly into the bowl to establish a normal water level therein.

SUMMARY OF THE INVENTION

The present invention relates generally to the field of toilets, and is more particularly concerned with the provision of a unique marine toilet of the wet type.

It is one object of the herein described invention to provide a marine jet toilet of the wet type.

A further object is to provide simple and improved means whereby a conventionally known dry type marine jet toilet may be converted to a wet type toilet.

Another object is to provide a marine toilet of the wet type in which a reservoir tank in a branch line connection with a top flushing rim of the bowl will function to provide a delayed action of the rim flushing, and also serve to impound fluid during a flushing operation, and which will upon termination of the flushing operation be automatically conducted to the bowl so as to provide a normal fluid level therein.

Still another object is to provide a unique reservoir tank, and means for operatively mounting it at the rear of the toilet bowl, the tank being so connected in the flushing system as to impound a quantity of fluid during a flushing operation, and thereafter deliver the impounded fluid into the bowl to provide a normal fluid level therein, whereby the toilet functions as a wet type.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figures 1, 2:
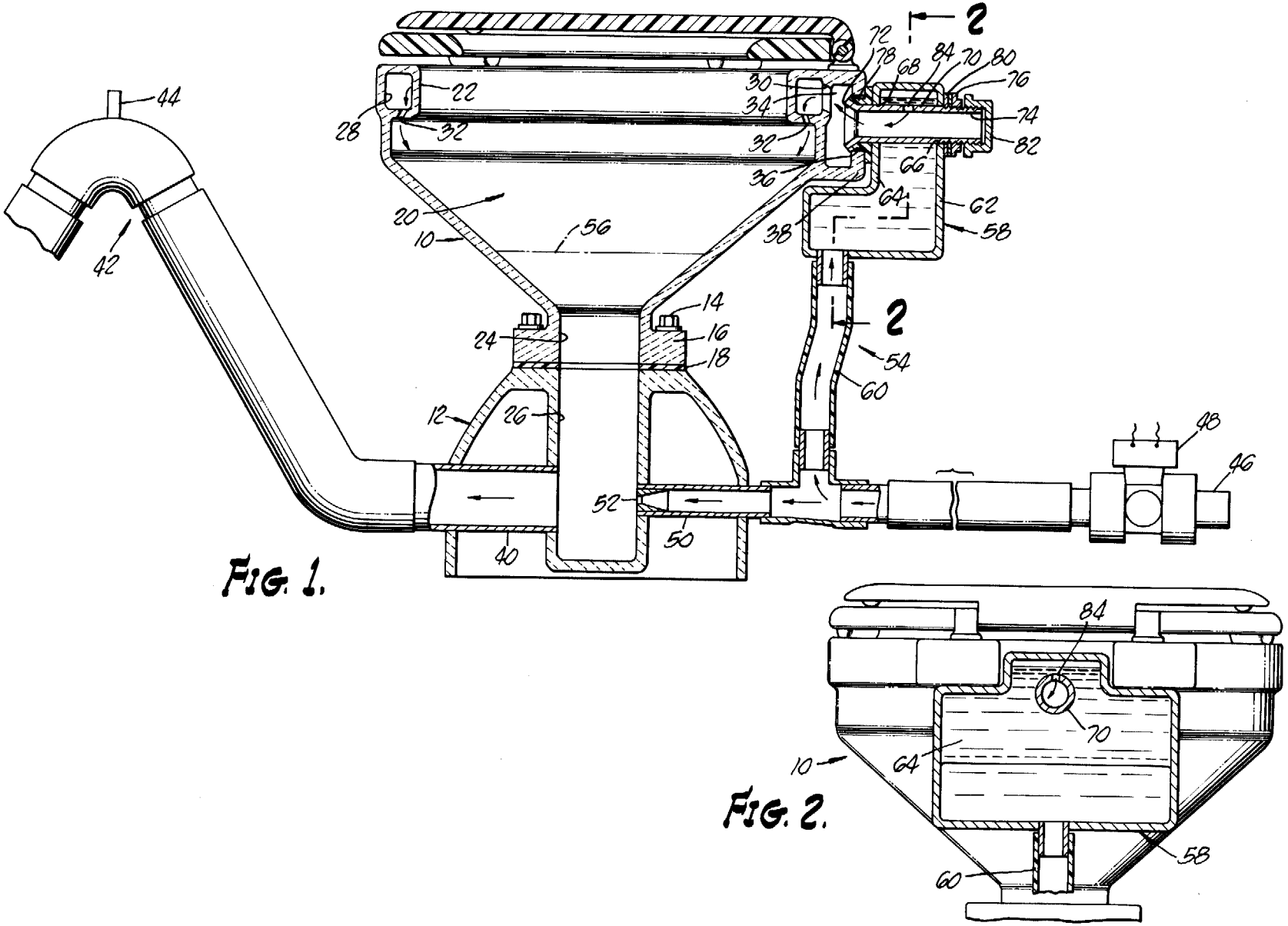
FIG. 1 is a side elevational view of a toilet according to the present invention, and showing its connection in a flushing system, portions being broken away and sectioned to disclose essential details of construction.
FIG. 2 is an elevational view of the back of the toilet including a section taken substantially on line 2—2 of FIG. 1.

For illustrative purposes, there is disclosed in FIG. 1 a marine type toilet bowl, as generally indicated by the numeral 10, the bowl being of conventional construction and being connected at its bottom end to a subbase 12 by means of mounting bolts 14 which extend through an attaching flange 16 and operate to hold the bowl in sealing engagement with an interposed sealing gasket 18.

More specifically, the toilet bowl is of conventional construction and is formed to provide a waste-receiving receptacle 20 having a top rim opening 22 and a bottom outlet connection 24 having communication with a depending sump 26 formed in the subbase 12.

The top rim opening 22 is surrounded by a circumferentially extending channel 28, this channel having a flushing water inlet opening 30 and a plurality of outlet flow openings 32 for the distribution of flushing water into the bowl. The inlet opening 30 is in communication with a water receiving chamber 34 formed in the rear rim portion of the bowl, this chamber having communication with a connection opening 36 in a rear wall 38 of the chamber.

The depending sump 26 is connected adjacent its lower closed end with a right-angled outlet tubular connection 40 which leads to a conventional inverted U-shaped discharge conduit and trap, as generally indicated by the numeral 42, and which is provided at its top flow point with a conventional venting device 44.

In the conventional flushing arrangement, the toilet bowl 10 is connected with an inlet conduit 46 from a fluid pressure source through an electric control valve 48 to the inlet of a jet nozzle 50, this nozzle having its discharge end 52 connected to the sump 26 on the opposite side thereof from the tubular connection 40, and in axial alignment therewith. It is also the usual practice in the conventional flushing arrangement to provide a branch connection, as generally indicated at 54, leading directly from a point upstream of the jet nozzle 50 to the water-receiving chamber 34.

The toilet arrangement as thus far described provides a so-called "dry" marine type toilet in which the water level is normally positioned below the upper end of the bottom outlet connection 24. A flushing operation is accomplished by activating the electric control valve 48, whereupon water simultaneously flows to the rim flushing channel 28 and to the jet nozzle 50 which emits a high pressure liquid jet discharge from its discharge end 50 into the tubular connection 40, and thus through Venturi action induces the removal of waste material from the toilet bowl into the tubular connection 40 and thence through the discharge conduit and trap 42. Closure of the control valve 48 terminates the flushing operation and the reestablishment of the water level in the bottom outlet connection 24.

It is a primary feature of the present invention that upon the termination of a flushing operation, the water level will be raised into a normal position above the bowl outlet, as indicated generally at 56. Thus, a "wet" type of marine toilet is provided.

This feature is accomplished by providing a reservoir tank, as generally indicated by the numeral 58, of about one quart capacity in the branch flow connection 54. This tank is connected at its bottom by means of a branch conduit 60 with the high pressure fluid supply to the jet nozzle 50. The upper or top portion of the tank is connected by a flow passage with the water receiving chamber 34, in a manner which will now be described in detail.

As will be seen in FIG. 1, the reservoir tank 58 is transversely of generally L-shaped configuration and at its top portion has spaced outer and inner walls 62 and 64, respectively, these walls having axially aligned openings 66 and 68 therein. The reservoir tank 58 is suspended from a tubular member 70 which is positioned in the openings 66 and 68, with a flared inner end 72 extending into the connection opening 36, and an outer opposite threaded end 74 which extends outwardly beyond the wall 62. A sealing nut 76 on the threaded end serves to compress appropriate sealing gaskets 78 and 80 with respect to the connection opening 36, wall opening 66 and wall opening 68, so that leakage at these points will be prevented. The outermost end of the tubular member 70 is closed by a threaded cap 82. A flow opening 84 in the top periphery of the tubular member 70 provides a flow connection between the top portion of the reservoir tank and the rim flushing channel 28 via the interior of tubular member 70, water receiving chamber 34, and water inlet opening 30.

The operation of the "wet" type marine toilet according to the present invention differs somewhat from that of the "dry" type of the heretofore known construction. In a similar manner, the flushing operation is accomplished by actuating the electric control valve 48 to open position. The jet nozzle 50 is now actuated and functions to remove the waste materials from the bowl by jet Venturi action. At the same time, water is supplied through the branch conduit 60 into the reservoir tank 58, and as the water level rises in the tank it will eventually flow through the flow opening 84 into the rim flushing channel 28. It should be noted, however, that this action is a delayed action due to the time required to fill the tank, and the restricted venting action through the opening 84. During the flushing action, it follows that the reservoir tank will be substantially filled and impound an amount of water depending upon the tank capacity. When the flushing operation is terminated by closing the electric control valve 48, impounded water in the reservoir tank will flow by gravity through the jet nozzle outlet 52 and into the sump 26, the water thus delivered from the tank functioning to raise the level of water in the bowl to the level indicated at 56. This level will be established at a position coincident with the bottom of the reservoir tank 58. It will thus be apparent that the present invention provides a very simple and economical means for changing a standard "dry" type marine toilet to a "wet" type.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In a marine toilet in which a toilet bowl structure has a top flushing rim and a bottom discharge outlet, said flushing rim and bottom outlet having flow connections with a controlled source of pressurized flushing fluid, the improvement comprising:

a. a reservoir tank positioned above the toilet bowl outlet, said tank having an outlet in connection with the flushing rim and an inlet in connection with said pressurized fluid source and said bottom outlet, whereby to receive and impound a quantity of the pressurized fluid during a flushing operation to discharge impounded fluid from the tank to the bottom discharge outlet into the bowl so as to form a normal fluid level therein.

2. A marine toilet according to claim 1, in which the bottom outlet comprises a sump with a connected side outlet; and including an aligned jet nozzle for discharging a high pressure jet across said sump into said outlet during a flushing operation.

3. A marine toilet according to claim 2, in which said reservoir tank is positioned above said jet nozzle and has its inlet in communication with said source of pressurized fluid through a branch connection upstream of said jet nozzle, whereby upon termination of a flushing operation fluid from said reservoir tank will flow by gravity through said jet nozzle into the sump.

4. A marine toilet according to claim 1, wherein the outlet of the reservoir tank is an upper flow connection in communication with said flushing rim, and the inlet is a lower flow connection in communication with the pressurized fluid connection for said bottom discharge outlet.

5. A marine toilet according to claim 4, in which said reservoir tank is positioned exteriorly adjacent said flushing rim.

6. A marine toilet according to claim 4, in which said reservoir tank provides a time flushing delay in the delivery of fluid to the flushing rim with respect to the delivery of flushing fluid to said bottom discharge outlet.

7. A marine toilet according to claim 1, in which the top flushing rim comprises a rim channel having a bowl fluid discharge opening; means supporting said reservoir tank on the rear of said bowl; a flow passage connection between the outlet of said tank and said rim channel; and a flow connection from the inlet of said reservoir tank to a connection between the controlled source of pressurized fluid and the bottom discharge outlet.

8. A marine toilet according to claim 7, in which the rim channel is in communication with a wall opening at the rear of said bowl; in which the supporting means comprises a tubular member having a projecting end portion extending outwardly from one wall of the upper end of said reservoir tank, said projecting end portion having a sealed connection with said wall opening; and in which said flow passage connection includes said tubular member.

9. A marine toilet according to claim 8, in which said tubular member further extends through said one wall, the interior of the reservoir tank and another spaced wall thereof, to provide an opposite projecting end portion; in which said flow passage connection comprises an opening in the top periphery portion of the tubular member positioned within said reservoir tank; and including sealing means for the tubular member at said walls; and means coacting with said opposite projecting end portion for retaining said reservoir tank and tubular member in assembled relation.

10. A marine toilet according to claim 9, wherein said opposite projecting end portion of said tubular member is closed by a removable cap member.

* * * * *